US006135972A

United States Patent [19]

Kuo

[11] Patent Number: 6,135,972

[45] Date of Patent: Oct. 24, 2000

[54] FLEXIBLE MASSAGER BAR

[76] Inventor: Shun-Lung Kuo, No. 53, Chung-Cheng St., Chung-Cheng Tsun, Hsinshe Hsiang, Taichung County, Taiwan

[21] Appl. No.: 09/324,175

[22] Filed: Jun. 3, 1999

[51] Int. Cl.[7] ..... A61H 15/00

[52] U.S. Cl. ..... 601/119; 601/120; 601/131; 601/132

[58] Field of Search ..... 601/118–123, 125, 601/128, 129, 131, 132

[56] References Cited

U.S. PATENT DOCUMENTS

| | | | |
|---|---|---|---|
| 472,572 | 4/1892 | Forest | 601/119 |
| 1,533,528 | 4/1925 | Weaver | 601/118 |
| 2,227,724 | 1/1941 | Kosa, Sr. | 601/132 X |
| 3,934,579 | 1/1976 | Brodbeck | 601/123 |
| 4,345,757 | 8/1982 | Lo Voi | 601/120 X |
| 5,386,992 | 2/1995 | Jaghab | 601/131 X |
| 5,554,102 | 9/1996 | Chiou | 601/72 |
| 5,588,953 | 12/1996 | Chang | 601/122 X |
| 5,709,705 | 1/1998 | Belcher | 601/120 X |

FOREIGN PATENT DOCUMENTS

| | | | |
|---|---|---|---|
| 631807 | 9/1927 | France | 601/120 |
| 274261 | 3/1928 | United Kingdom | 601/21 |

*Primary Examiner*—Mickey Yu
*Assistant Examiner*—Denise Pothier
*Attorney, Agent, or Firm*—Rosenberg, Klein & Lee

[57] ABSTRACT

A flexible massager bar, which includes a flexible round rod, two hand grips fixedly fastened to two opposite ends of the round rod, and a plurality of massaging wheels respectively turned about the round rod between the hand grips, the massaging wheels each holding a set of rotating balls around the periphery for massaging.

4 Claims, 5 Drawing Sheets

A — A

FLEXIBLE MASSAGER BAR

BACKGROUND OF THE INVENTION

The present invention relates to a massager bar for massaging the body, and more particularly to a flexible massager bar which comprises a round rod having hand grips at two opposite ends, and a set of wheels turned about the flexible round rod between the hand grips.

Conventional massager bars for massaging the body commonly include two types. The first type is a wooden bar having raised portions around the periphery. The second type is comprised of an elongated wooden or metal rod, and a plurality of massaging rings turned about the rod. The massaging rings each have a plurality of raised portions around the periphery for massaging. Because these conventional massager bars are not flexible, they cannot be curved to fit the curvature of the part of the body being massaged. Therefore, these conventional massager bars do not achieve a high massaging effect. Furthermore, because these conventional massager bars have only a hand grip at one end, they are not practical for operation with both hands. Therefore, conventional massager bars are not functional for massaging certain part of the body.

SUMMARY OF THE INVENTION

The present invention has been accomplished to provide a flexible massager bar which eliminates the aforesaid drawbacks. According to one aspect of the present invention, the massager bar is comprised of a round rod, two hand grips fixedly fastened to the round rod at two opposite ends, and a plurality of massaging wheels turned about the round rod between the hand grips. According to another aspect of the present invention, the round rod is flexible, so that the massager bar can be curved to fit the part of the body under massaging. According to still another aspect of the present invention, the massaging wheels each are comprised of two shells fastened together, and a set of balls respectively turned in between the shells around the periphery.

DETAILED DESCRIPTION OF THE PREFERRED EMBODIMENT

Figures 1A, 1B:
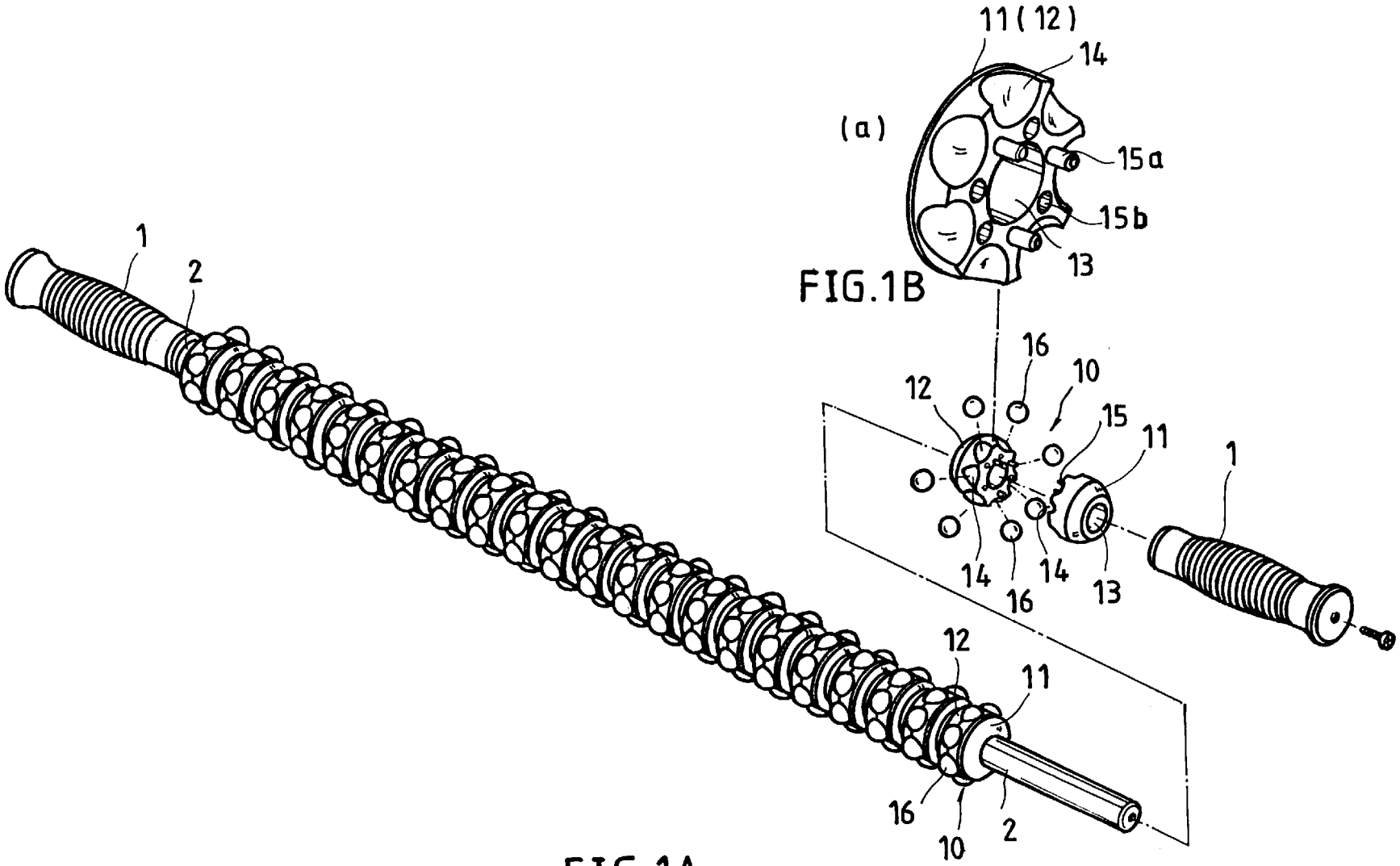
FIG. 1A is an exploded view of a flexible massager bar according to the present invention.
FIG. 1B is a perspective view of one shell for one massaging wheel according to the present invention.
Figure 2:
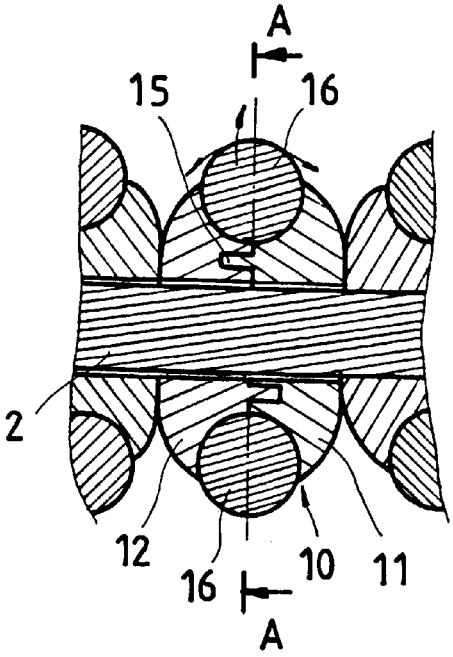
FIG. 2 is a sectional assembly view of a part of the present invention.
Figure 3:
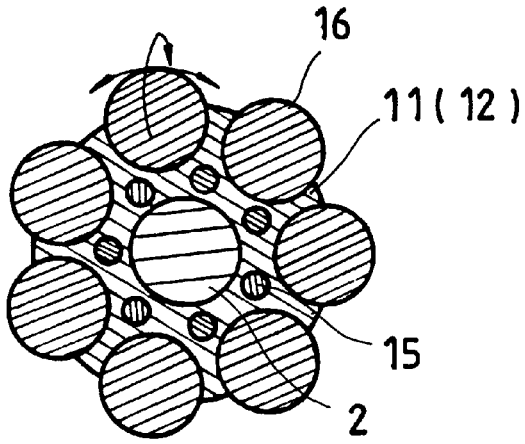
FIG. 3 is a cross sectional view taken along line A—A of FIG. 2.
Figure 4:
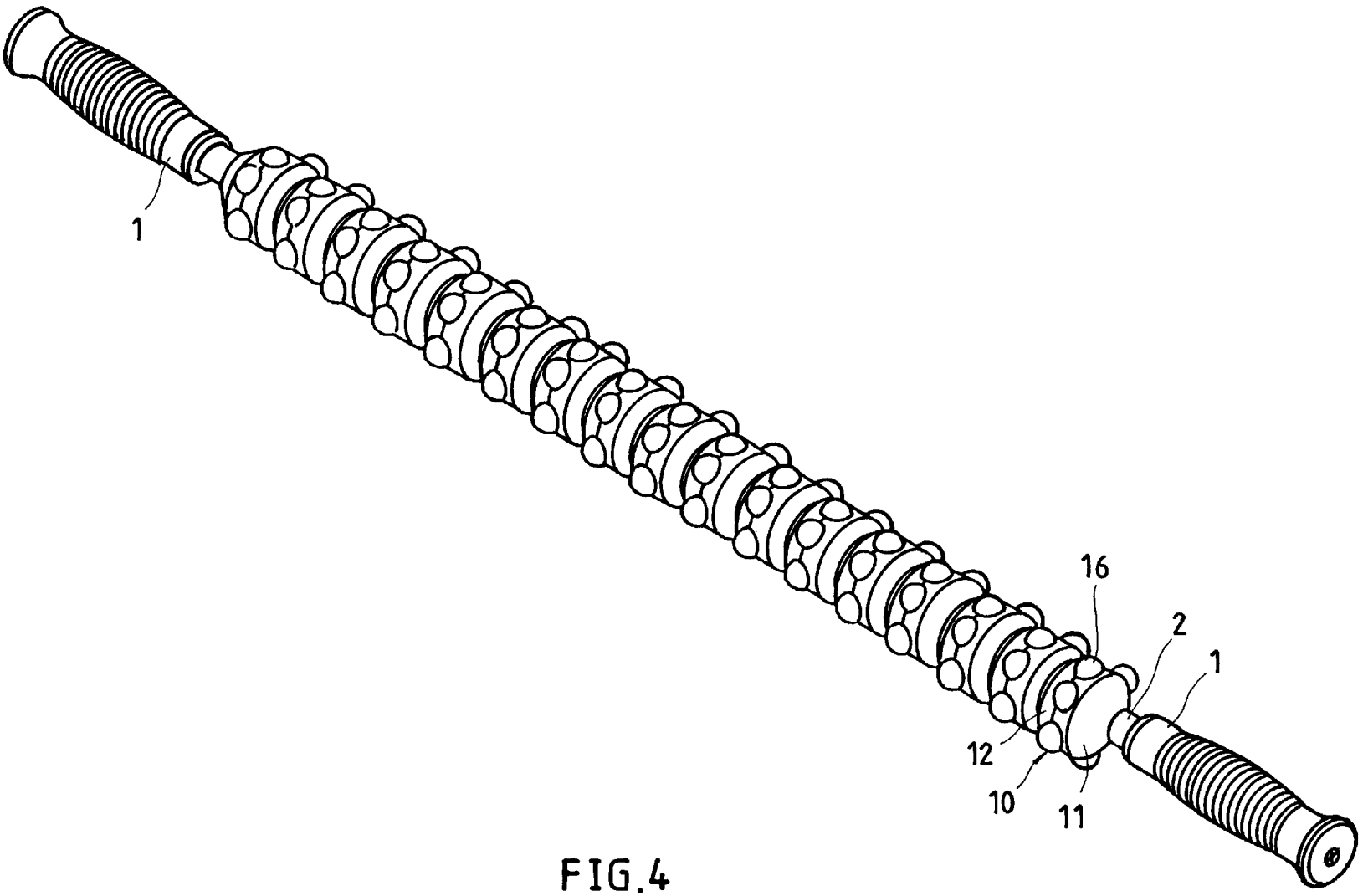
FIG. 4 is a perspective view of the flexible massager bar according to the present invention.

Referring to Figures from 1 through 4, a flexible massager bar in accordance with the present invention comprises a round rod 2, two hand grips 1 respectively fastened to the two opposite ends of the round rod 2 as endpieces thereof, and a plurality of massaging wheels 10 mounted on the round rod 2 between the hand grips 1. The round rod 2 is molded from flexible plastic material, so that the massager bar can be curved. The massaging wheels 10 each are comprised of two symmetrical shells 11 and 12, and a set of balls 16 mounted in between the symmetrical shells 11 and 12. The shells 11 and 12 each comprise a center through hole 11, which receives the round rod 2, a plurality male and female fastening elements 15 including equal number of plug pins 15*a* and pin holes 15*b* alternatingly spaced around the center through hole 13, and a plurality of recessed portions 14 equiangularly spaced around the center through hole 13 at the border area for the positioning of the balls 16. By plugging the plug pins 15*a* at one shell 11 or 12 into the pin holes 15*b* at the other shell 12 or 11, the shells 11 and 12 are fastened together to hold the balls 16 in the recessed portions 14.

Figure 5:
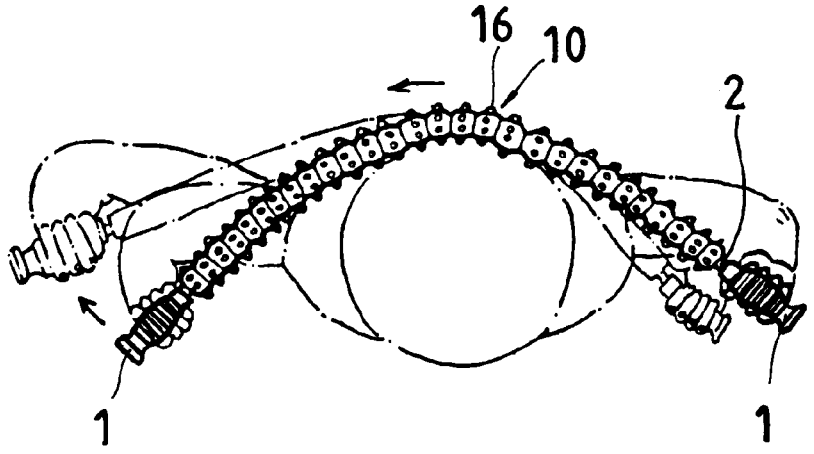
FIG. 5 shows an application example of the present invention.
Figure 6:
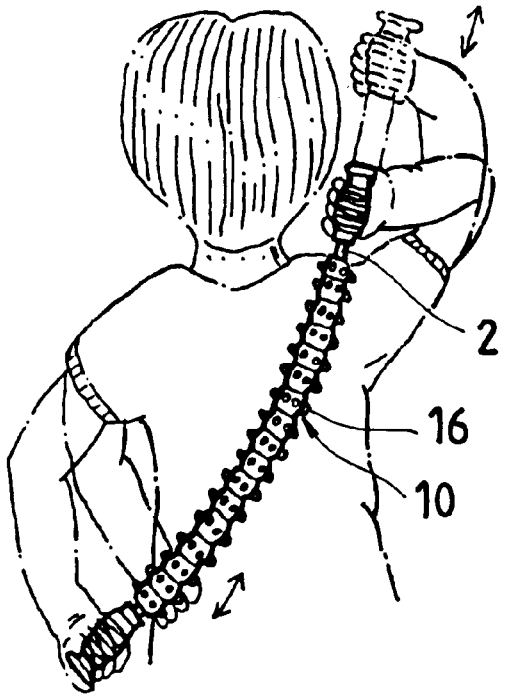
FIG. 6 shows another application example of the present invention.

Referring to FIGS. 5 and 6, when in use, the hand grips 1 are held in both hands, and then the massager bar is bent by hand and rubbed against the body (the neck, the back, or any part of the body), causing the body to be massaged. Because the massager bar is flexible, it can be curved to fit the curvature of the part of the body to be massaged. This feature enables the massager bar to effectively massage any part of the body. When the massager bar is rubbed against the body, the wheels 10 are rotated on the round rod 2 of the massager bar against the body, and the balls 16 are rotated in the respective recessed portions 14 against the body, and therefore a satisfactory massaging effect is achieved.

Figure 7:
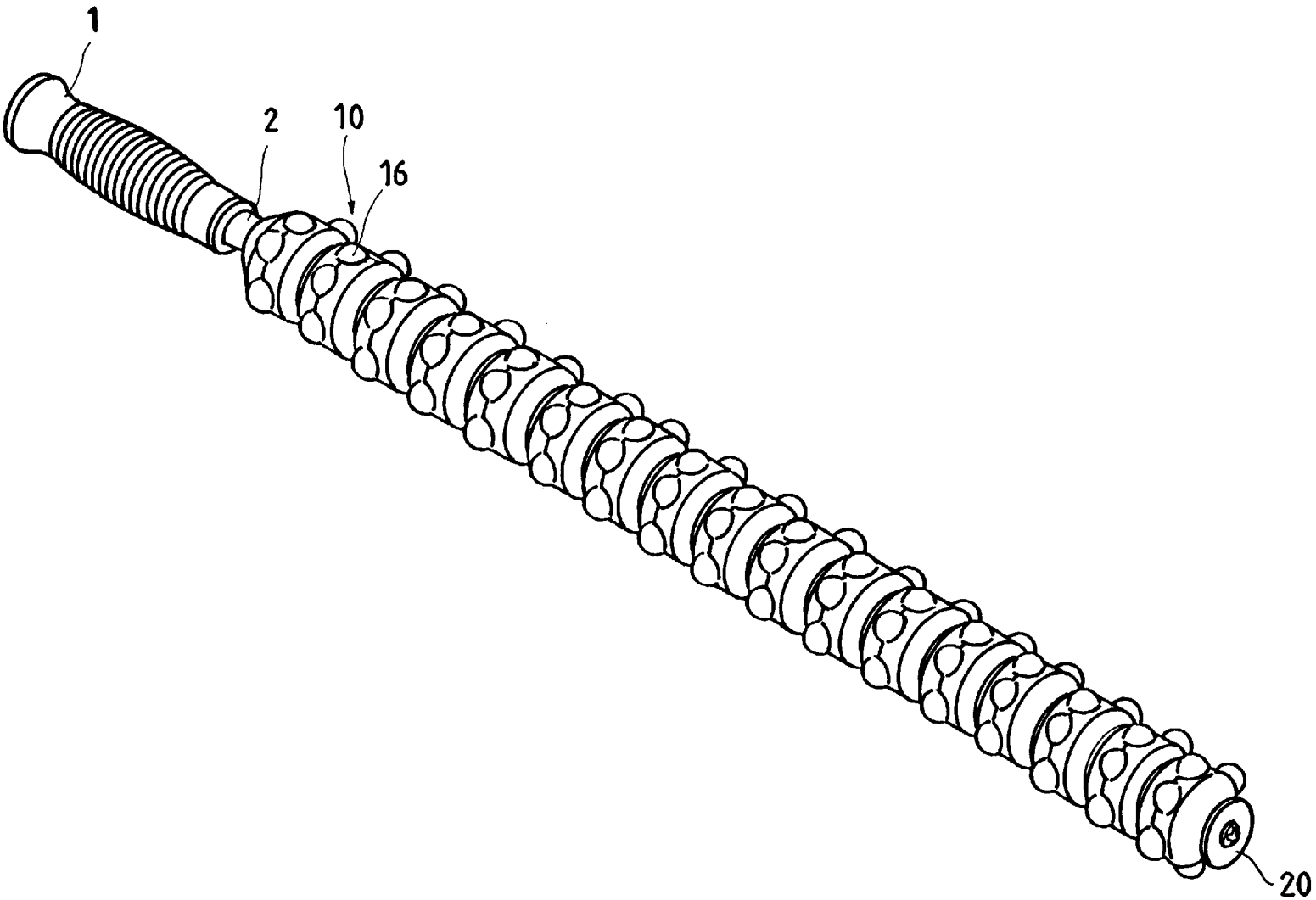
FIG. 7 is a perspective view of an alternate form of the present invention.

FIG. 7 shows an alternate form of the present invention. According to this embodiment, only one hand grip 1 is provided and fastened to one end of the flexible round rod 2 as one endpiece, and the other end of the round rod 2 is fixedly mounted with an end stop 20 as another endpiece. This alternate form is suitable for massaging the hands, legs, back of the body by beating.

What the invention claimed is:

1. A flexible massager bar comprising:

a flexible round rod having a first end and a second end;

a first endpiece and a second endpiece respectively fastened to the first end and second end of said flexible round rod; and a plurality of massaging wheels respectively rotatable mounted on said flexible round rod between said first endpiece and said second endpiece, said massaging wheels each consisting of two convex symmetrical shells, and a plurality of balls rotatably mounted in between said symmetrical shells, said shells each comprising a center through hole for receiving said flexible round rod therethrough, a plurality of male plug pins and pin holes alternatingly spaced around said center through hole, and a plurality of recessed portions equiangularly spaced around said center through hole in a peripheral portion of said shell for respectively receiving said plurality of balls therein, the plug pins of one of said shells being respectively plugged into the pin holes of the other of said shells.

2. The flexible massager bar of claim 1 wherein said first endpiece and said second endpiece are hand grips.

3. The flexible massager bar of claim 1 wherein said first endpiece is a hand grip, and said second endpiece is an end stop.

4. The flexible massager bar of claim 1 wherein said flexible round rod is formed of a plastic material composition.

* * * * *